US009744786B2

(12) United States Patent
Kato et al.

(10) Patent No.: US 9,744,786 B2
(45) Date of Patent: Aug. 29, 2017

(54) LIQUID DISCHARGING APPARATUS

(71) Applicant: Seiko Epson Corporation, Tokyo (JP)

(72) Inventors: Junya Kato, Matsumoto (JP); Tsuneyuki Sasaki, Matsumoto (JP); Yugo Ishikawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/212,483

(22) Filed: Jul. 18, 2016

(65) Prior Publication Data

US 2017/0028754 A1 Feb. 2, 2017

(30) Foreign Application Priority Data

Jul. 28, 2015 (JP) ..... 2015-148674
May 11, 2016 (JP) ..... 2016-095114

(51) Int. Cl.
*B41J 11/00* (2006.01)
*B41J 29/393* (2006.01)
*B41J 25/304* (2006.01)

(52) U.S. Cl.
CPC ..... *B41J 29/393* (2013.01); *B41J 11/005* (2013.01); *B41J 25/304* (2013.01)

(58) Field of Classification Search
CPC .... B41J 25/304; B41J 29/393; B41J 2/04581; B41J 11/005
See application file for complete search history.

(56) References Cited

U.S. PATENT DOCUMENTS 5,468,076 A * 11/1995 Hirano ..... B41J 25/3088 347/8
5,476,328 A * 12/1995 Hori ..... B41J 25/3082 400/56
5,541,626 A 7/1996 Hiramatsu et al.
5,934,140 A * 8/1999 Jackson ..... G01N 33/346 250/559.27
7,043,962 B2 * 5/2006 Sakai ..... B41J 11/009 73/12.01
7,182,338 B2 * 2/2007 Akaike ..... G01N 33/34 271/265.04
2003/0090573 A1 * 5/2003 Tojo ..... H04N 1/00888 348/207.2
2009/0160925 A1 * 6/2009 Shinkawa ..... B41J 11/002 347/102
2010/0079775 A1 * 4/2010 Matoba ..... B41J 11/0095 358/1.9

(Continued)

FOREIGN PATENT DOCUMENTS

JP 05-301413 A 7/1996
JP 10-152245 A 6/1998
JP 2005-003908 A 1/2005

*Primary Examiner* — Manish S Shah
*Assistant Examiner* — Yaovi M Ameh
(74) *Attorney, Agent, or Firm* — Workman Nydegger

(57) ABSTRACT

A liquid discharging apparatus is provided with a liquid discharging section that discharges a liquid onto a medium, and a transport section that transports the medium, and a piezoelectric film sensor is provided in the liquid discharging section. Due to a liquid discharging apparatus having such a configuration, it is possible to suppress a circumstance in which at least one of the medium and the liquid discharging section become damaged due to contact between the medium and the liquid discharging section.

14 Claims, 7 Drawing Sheets

(56) References Cited

U.S. PATENT DOCUMENTS

2013/0002761 A1* 1/2013 Iwata ..... B41J 19/20
347/37
2014/0368567 A1* 12/2014 Kobayashi ..... B41J 2/07
347/9

* cited by examiner

LIQUID DISCHARGING APPARATUS

BACKGROUND

1. Technical Field

The present invention relates to a liquid discharging apparatus.

2. Related Art

Liquid discharging apparatuses that discharge a liquid such as ink onto a transported recording medium, are used in the related art. In such liquid discharging apparatuses, when a transported recording medium and a liquid discharging section come into contact with one another, there are cases in which at least one of the recording medium and the liquid discharging section is damaged. In such an instance, various techniques for suppressing contact between a recording medium and a liquid discharging section have been disclosed.

For example, JP-A-5-301413 discloses a liquid discharging apparatus (an ink jet recording apparatus) that suppresses contact between a recording medium and a liquid discharging section (a recording head) by detecting transport abnormalities of the recording medium using an optical detection unit.

However, in optical detection units such as that disclosed in JP-A-5-301413, mechanical detection units of the related art, and the like, there are cases in which it is falsely determined that a recording medium and a liquid discharging section are in contact with one another in a case in which the recording medium and the liquid discharging section are not in contact with one another, cases in which it is falsely determined that a recording medium and a liquid discharging section are not in contact with one another in a case in which the recording medium and the liquid discharging section are in contact with one another, and the like. In this manner, the detection accuracy of detection units of the related art that detect contact between a recording medium and a liquid discharging section, is low. The technical problem is that there are cases in which at least one of a recording medium and a liquid discharging section is damaged as a result of contact between the recording medium and the liquid discharging section due to low detection accuracy.

SUMMARY

The invention can be realized in the following application examples or aspects.

A liquid discharging apparatus according to a first aspect of the invention includes a liquid discharging section that discharges a liquid onto a medium, and a transport section that transports the medium, and a piezoelectric film sensor is provided in the liquid discharging section.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments in which the invention is given specific forms will be described with reference to the drawings. Hereinafter, a recording apparatus according to a working example is described as a liquid discharging apparatus of the invention, but does not limit the invention. Additionally, in each of the following drawings, there are cases in which scales that differ from practical scales are shown in order to make the description easier to understand. In addition, unless otherwise specified, the term "intersecting" refers to "preferably being orthogonal to".

Embodiment 1

A recording apparatus according to the present embodiment is provided with a liquid discharging section that discharges a liquid onto a recording medium, a transport section that transports the recording medium in a transport direction, a piezoelectric film sensor that is provided in the liquid discharging section and outputs depending on an extent of deformation due to contact with the recording medium, and a control section that performs control of the liquid discharging section and/or the transport section. In addition, the control section has a configuration in which more suitable control of the liquid discharging section and/or the transport section is possible depending on the extent of a state of contact between the recording medium and the liquid discharging section.

Hereinafter, a plurality of working examples in which the configuration that attaches the piezoelectric film sensor differs, will be described specifically.

Working Example 1

FIGS. 1 to 4

Figure 1:
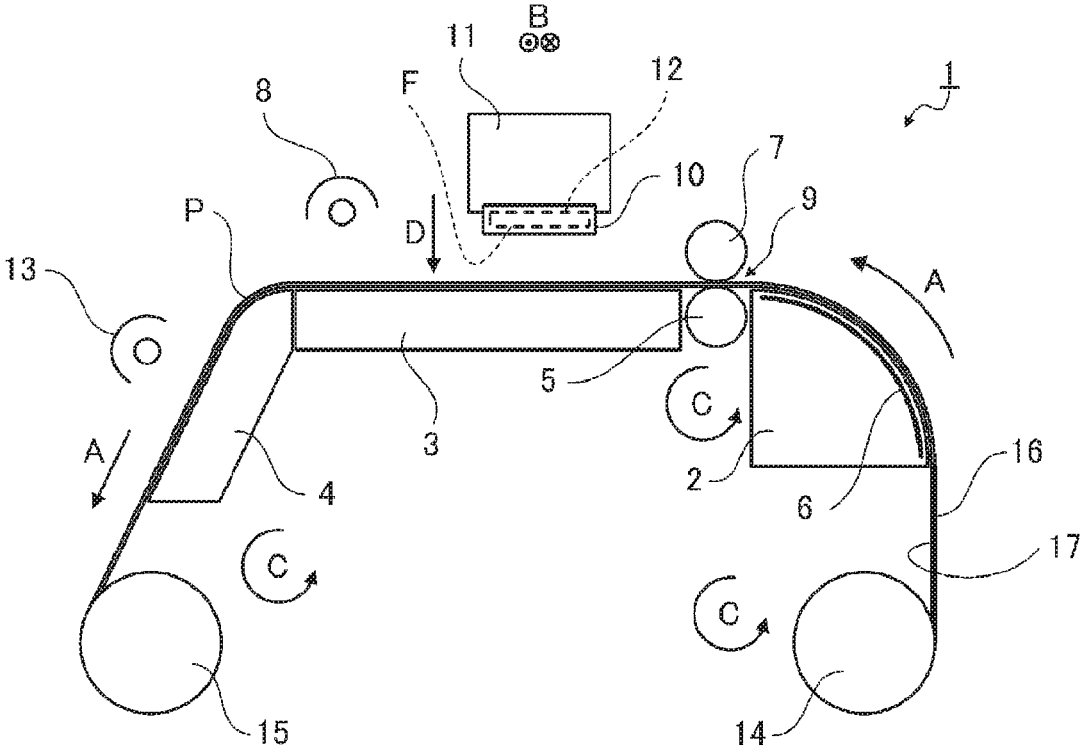
FIG. 1 is a schematic side view that shows a recording apparatus according to Working Example 1 of the invention.

FIG. 1 is a schematic side view that shows a recording apparatus 1 of Working Example 1 of the invention.

As shown in FIG. 1, the recording apparatus 1 of the present working example transports a recording medium P in a transport direction A from a setting section 14 of the recording medium P to a wind-up section 15 of the recording medium P via a platen 2, a platen 3 and a platen 4 which are support sections of the recording medium P. That is, from the setting section 14 to the wind-up section 15 is a transport pathway of the recording medium P in the recording apparatus 1, and the platen 2, the platen 3 and the platen 4 are support sections of the recording medium P that are provided in the transport pathway.

Additionally, the setting section 14 delivers the recording medium P by rotating in a rotational direction C, and the wind-up section 15 winds the recording medium P up by rotating in the rotational direction C.

Additionally, the recording apparatus 1 of the present working example has a configuration in which it is possible to perform recording on a roll-shaped recording medium P, but the invention is not limited to such as configuration, and a configuration in which it is possible to perform recording on single sheets of recording medium P, may also be used. In a case of a configuration in which it is possible to perform recording on a single sheet recording medium P, for example, a setting section referred to as a paper feeding (feeding) tray, a paper feeding (feeding) cassette, or the like, may be used as the setting section 14 of the recording medium P. In addition, as a recovery section of the recording medium P, for example, a recovery section referred to as a so-called ejection reception section, a paper ejection (ejection) tray, a paper ejection (ejection) cassette, or the like, may be used as a recovery section other than the wind-up section 15.

Additionally, in the present working example, since a roll form recording medium P, which is wound so that a recording surface 16 is on an outer side, is used, when the recording medium P is delivered from the setting section 14, an axis of rotation of the setting section 14 rotates in a rotational direction C. Meanwhile, in a case in which a roll form recording medium P, which is wound so that the recording surface 16 is on an inner side, is used, the axis of rotation of the setting section 14 can deliver the recording medium P by rotating in the opposite direction to the rotational direction C.

Further, in the same manner, since the wind-up section 15 of the present working example winds the recording medium P up in a manner in which the recording surface 16 of the recording medium P is on the outer side, the axis of rotation of the wind-up section 15 rotates in the rotational direction C. Meanwhile, in a case of winding the recording medium P up so that the recording surface 16 is on the inner side, the axis of rotation of the wind-up section 15 can wind the recording medium P up by rotating in the opposite direction to the rotational direction C.

A heater 6 is provided in the platen 2 of the recording apparatus 1 of the present working example. The heater 6 is provided in order to heat (so-called preheating) the recording medium P before executing recording using a recording head 12 as a recording section.

Additionally, the recording apparatus 1 of the present working example has a configuration that preheats the recording medium P from surface 17 side on a side that is opposite to the recording surface 16 of the recording medium P using the heater 6. However, for example, the recording apparatus 1 may have a configuration that preheats the recording medium P from a recording surface 16 side of the recording medium P using a heater is capable of heating the recording medium P through irradiation with infrared rays from the recording surface 16 side.

In addition, in the recording apparatus 1 of the present working example, a driving roller 5 that applies a feeding force to the surface 17 of the recording medium P and has an axis of rotation in an intersecting direction B, which intersects the transport direction A, is provided between the platen 2 and the platen 3.

Further, a driven roller 7 that has an axis of rotation in the intersecting direction B, is provided in a position that faces the driving roller 5. It is possible to pinch the recording medium P using the driving roller 5 and the driven roller 7, which configure a pair of rollers. As a result of such a configuration, a transport section 9 is configured by the driving roller 5 and the driven roller 7. In this instance, the term driven roller refers to a roller that rotates in accordance with transport of the recording medium P.

In addition, when the recording medium P is transported in the transport direction A, the driving roller 5 rotates in the rotational direction C, and the driven roller 7 rotates in a direction that is opposite to the rotational direction C.

In addition, the recording apparatus 1 of the present working example is provided with the recording head 12 on a side that faces the platen 3 of a carriage 11. The recording apparatus 1 forms a desired image by discharging an ink, which is an example of a liquid, in a direction D (a direction facing the recording medium P from the nozzle formation surface F, a perpendicularly downward direction in the present working example) onto the recording medium P from a nozzle formation surface F of the recording head 12 while causing the recording head 12 to reciprocate in the intersecting direction B using the carriage 11. As a result of such a configuration, the recording head 12 can discharge ink, as a liquid, onto the recording medium P. That is, the carriage 11 of the present working example has a role as a "liquid discharging section" that is provided with the recording head 12 and discharges a liquid onto the recording medium P.

Additionally, the recording apparatus 1 of the present working example is provided with the recording head 12, which records while reciprocating, but may be provided with a so-called line head in which a plurality of nozzles, which discharge an ink, are provided in the intersecting direction B, which intersects the transport direction A. In a case of a recording apparatus that is provided with a line head, the line head corresponds to a "liquid discharging section".

In this instance, a "line head" is a recording head that is used in a recording apparatus that forms images by relatively moving the recording head or the recording medium P, and in which a region of nozzles formed in the intersecting direction B, which intersects the transport direction A of the recording medium P, is provided in a manner in which it is possible to cover the entirety of the recording medium P in intersecting direction B. Additionally, the region of the nozzles of the line head in the intersecting direction B need not be capable of covering the entirety of all of the recording medium P that the recording apparatus handles in the intersecting direction B.

In addition, skirts 10 in which piezoelectric film sensors 32 (refer to FIG. 2 and FIG. 3) are provided, are formed on both side end sections in the intersecting direction B of the carriage 11. The skirts 10 are members for suppressing a circumstance in which the recording medium P and the recording head 12 come into contact with one another. The specific configurations of the piezoelectric film sensor 32 and the skirts 10 will be described later.

In addition, a heater 8 is provided on a downstream side of the recording head 12 in the transport direction A as a heating section that is capable of irradiating a region in which recording is to be performed by the recording head 12, with infrared rays (refer to FIG. 1).

Additionally, the heater 8 of the present working example is provided in a position that faces the platen 3, and is an infrared ray heater that is capable of heating the recording surface 16 side of the recording medium P, but the invention is not limited such a heater, and a heater that is capable of heating the recording medium P from a platen 3 side (the surface 17 side), may also be used.

In addition, a heater 13 that is capable of radiating infrared rays is provided on a downstream side of the heater 8 in the transport direction A of the recording medium P. Additionally, the heater 13 of the present working example is provided in a position that faces the platen 4, and is an infrared ray heater that is capable of heating the recording surface 16 side of the recording medium P, but the invention is not limited such a heater, and a heater that is capable of heating the recording medium P from a platen 4 side (the surface 17 side), may also be used. In addition, for example, it is possible to use a blower device such as a fan in place of a heating device such as an infrared ray heater.

Next, the configurations of the piezoelectric film sensor 32 and the skirts 10, which are the main sections of the recording apparatus 1 of the present working example, will be described.

Figure 2:
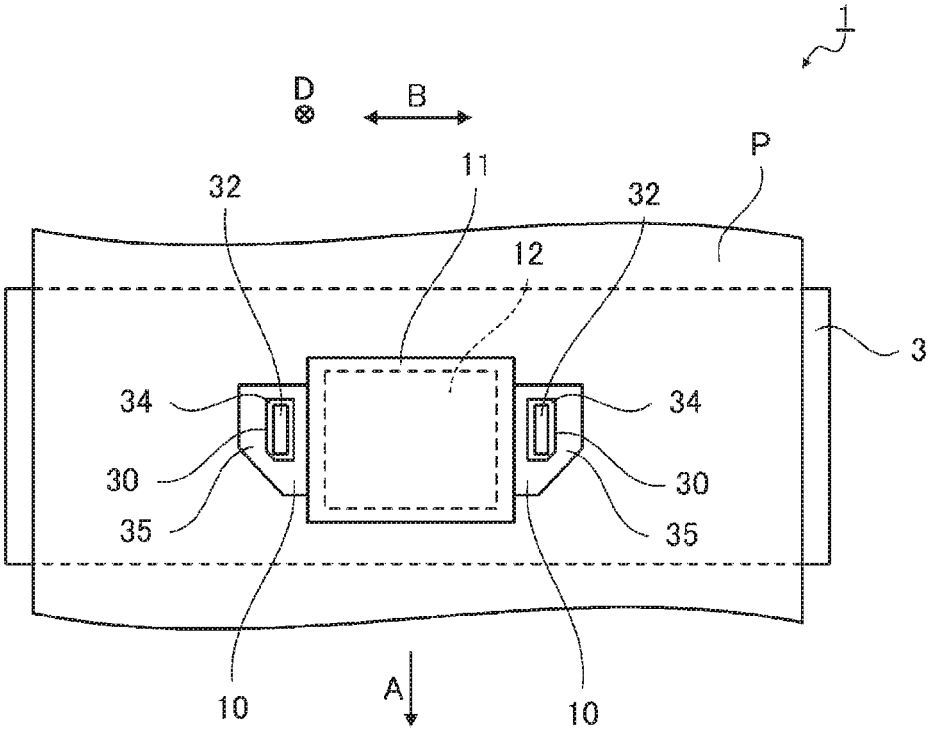
FIG. 2 is a schematic plan view that shows main sections of the recording apparatus according to Working Example 1 of the invention.
Figure 3:
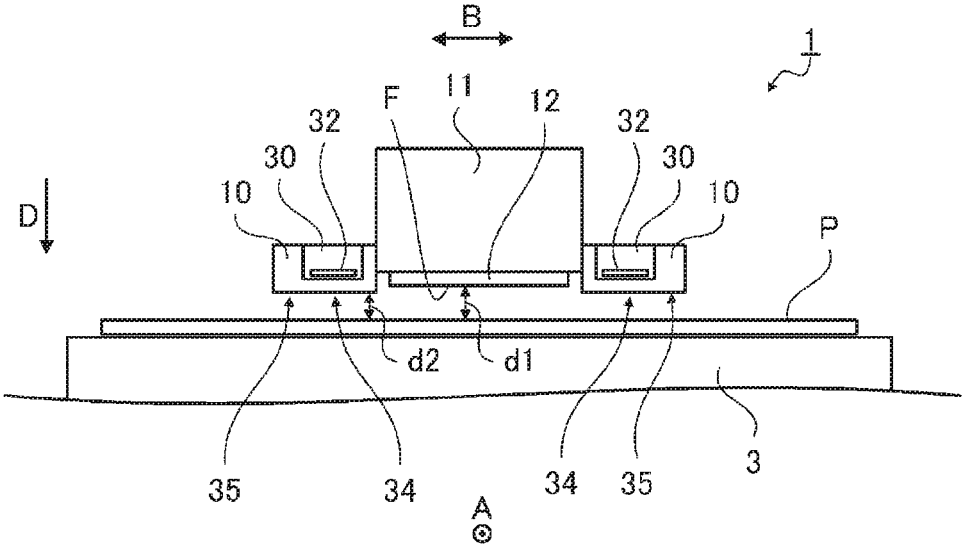
FIG. 3 is a schematic front cross-sectional view that shows the main sections of the recording apparatus according to Working Example 1 of the invention.

FIG. 2 is a schematic plan view that shows the carriage 11 of the present working example, and FIG. 3 is a schematic front cross-sectional view that shows the carriage 11.

In the carriage 11 of the present working example, the skirts 10 in which the piezoelectric film sensors 32 are provided, are formed on both side end sections in the intersecting direction B of the carriage 11 in the manner shown in FIG. 2 and FIG. 3. Additionally, as shown in FIG. 3, the skirts 10 have a configuration in which an interval d2 between the recording medium P and the lower surfaces of the skirts 10 is more narrow than an interval d1 between the recording medium P and the recording head 12 (the nozzle formation surface F).

In the abovementioned manner, the recording apparatus 1 of the present working example is provided with a carriage 11, which is provided with the recording head 12 that discharges an ink onto the recording medium P, and a transport section 9 that transports the recording medium P. Further, as shown in FIG. 2 and FIG. 3, the piezoelectric film sensor 32 are provided in the skirts 10 (that is, the carriage 11). Therefore, the recording apparatus 1 of the present working example has a configuration that can detect slight distortions of the carriage 11 due to the piezoelectric film sensors 32 being provided in the carriage 11 as the liquid discharging section. That is, the recording apparatus 1 of the present working example can detect contact between the recording medium P and the carriage 11 with high accuracy (accuracy that corresponds to slight distortions) by detecting slight distortions, and can suppress a circumstance in which at least one of the recording medium P and the carriage 11 (in particular, the recording head 12) becomes damaged as a result of the recording medium P and the carriage 11 coming into contact with one another.

Additionally, the piezoelectric film sensors 32 of the present working example are provided in the skirts 10, but the invention is not limited to disposition in such a position. In the abovementioned manner, the piezoelectric film sensors 32 are sensors having high detection accuracy that are capable of detecting slight distortions. Further, if the carriage 11 and the recording medium P come into contact with one another, there is a tendency for the carriage 11 to become wholly deformed. Therefore, it is possible to detect contact between the carriage 11 and the recording medium P even if the piezoelectric film sensors 32 are provided in locations other than the skirts 10 such as side surface portions of the carriage 11.

However, since there is a tendency for the distortions to be larger in locations that are close to a contact position with the recording medium P, for example, in the manner of the present working example, it is preferable that the piezoelectric film sensor 32 are disposed close to the recording medium P such as disposing attachment sections 34 (refer to FIG. 3) of the piezoelectric film sensors 32 in position that face the recording medium P. Furthermore, since the piezoelectric film sensors 32 are disposed particularly close to the recording medium P, in the manner of the present working example, it is preferable that the attachment sections 34 of the piezoelectric film sensors 32 are disposed so that an interval d2 between the recording medium P and the lower surfaces of the attachment sections 34 (the lower surfaces of the skirts 10) is more narrow than an interval d1 between the recording medium P and the recording head 12.

In addition, in a case in which displacement (deformation) of the piezoelectric film sensors 32 is detected, the recording apparatus 1 of the present working example can stop at least one of the discharge of the ink by the recording head 12 provided in the carriage 11 and the transport of the recording medium P by the transport section 9 using the control of a control section 18 (refer to FIG. 4), which will be described later. In this instance, the piezoelectric film sensors 32 are sensors that are configured as a result of a piezoelectric element being arranged in film form, and are sensors having high accuracy that are capable of detecting slight distortions of portions to which the piezoelectric film sensors 32 are attached as displacements. That is, the recording apparatus 1 of the present working example can detect contact between the recording medium P and the carriage 11 with high accuracy (accuracy that corresponds to slight distortions of portions to which the piezoelectric film sensors 32 are attached) using the piezoelectric film sensors 32. Further, as a result of the control of the control section 18, in a case in which contact between the recording medium P and the carriage 11 is detected, it is possible to stop at least one of the discharge of the ink by the recording head 12 of the carriage 11 and the transport of the recording medium P by the transport section 9 in order to suppress a circumstance in which at least one of the recording medium P and the carriage 11 becomes damaged. Therefore, the recording apparatus 1 of the present working example can suppress a circumstance in which at least one of the recording medium P and the carriage 11 becomes damaged due to the recording medium P and the carriage 11 coming into contact with one another.

Additionally, an action of discharging the ink that is stopped as a result of the control of the control section 18 also includes a movement action of the carriage 11 to the intersecting direction B.

In addition, in the abovementioned manner, in the recording apparatus 1 of the present working example, the carriage 11 (the recording head 12) is capable of discharging the ink while reciprocating in the intersecting direction B, which intersects the transport direction A of the recording medium P. Further, as a result of the control of the control section 18, it is possible to make the detection of displacement of the piezoelectric film sensor 32 effective only in a constant movement rate period in the reciprocation of the carriage 11.

In the reciprocation of the carriage 11, there is an acceleration movement period of accelerating from a stopped state to a constant rate state of speed, a constant movement rate period, and a deceleration movement period of decelerating from the constant rate state to the stopped state. In this instance, since force is applied to the carriage 11 in the acceleration movement period and the deceleration movement period, there are cases in which the carriage 11 is deformed (warped). Therefore, in the acceleration movement period and the deceleration movement period, there is a concern that deformation of the carriage 11 due to either acceleration or deceleration, will be falsely determined as deformation of the carriage 11 due to contact between the recording medium P and the carriage 11. However, in the recording apparatus 1 of the present working example, it is possible for the carriage 11 to discharge ink while reciprocating in the intersecting direction B, which intersects the transport direction A of the recording medium P, and the detection of displacement of the piezoelectric film sensors 32 is only effective in the constant movement rate period in the reciprocation of the carriage 11. Therefore, the recording apparatus 1 has a configuration that can suppress the above-mentioned false determination.

Additionally, in the present working example, a configuration in which the detection of the displacement of the piezoelectric film sensors 32 is only effective in the constant movement rate period in the reciprocation of the carriage 11" is a configuration that stops detection in the acceleration movement period and the deceleration movement period of the carriage 11, but may also be a configuration that performs detection in the acceleration movement period and the deceleration movement period of the carriage 11 using different criteria (for example, increasing a threshold value in the acceleration movement period and the deceleration movement period) to the constant movement rate period.

In addition, as shown in FIG. 2 and FIG. 3, the attachment sections 34 of the piezoelectric film sensors 32 in the carriage 11 of the present working example are configured to be thinner than peripheral sections 35 of the attachment section 34 and are configured so that the rigidity thereof is lower than that of the peripheral sections 35. More specifically, as shown in FIG. 3, hole sections 30 having planar bottom surfaces are configured in the skirts 10 with uniform thickness in the direction D, and the piezoelectric film sensors 32 are pasted onto bottom surface portions of the hole sections 30. That is, in the recording apparatus 1 of the present working example, the skirts 10 are configured solidly by configuring the peripheral sections 35 with high rigidity while increasing detection accuracy by making it easier for the attachment sections 34 of the piezoelectric film sensors 32 to become distorted. Therefore, the recording apparatus 1 has a configuration in which it is possible to form the carriage 11 with high detection accuracy in a manner in which it is difficult to break, and it is possible to effectively suppress a circumstance in which at least one of the recording medium P and the carriage 11 becomes damaged due to the recording medium P and the carriage 11 coming into contact with one another.

Additionally, in the manner of the present working example, the piezoelectric film sensors 32 can be attached by being pasted onto a pasting target. In such an instance, by pasting the piezoelectric film sensors 32 onto the carriage 11, it is possible to detect distortion of the carriage 11 with higher accuracy than other pasting methods.

Mata as shown in FIG. 2 and FIG. 3, the piezoelectric film sensors 32 are provided in the carriage 11 of the present working example on both sides in the intersecting direction B, which is a direction of reciprocation, in positions of the recording head 12, which is a discharge position of the ink of the carriage 11. Therefore, during movement in both directions in the reciprocation of the carriage 11, the piezoelectric film sensors 32 have configurations that can detect a circumstance in which the recording medium P and the carriage 11 come into contact with one another with high accuracy (accuracy that corresponds to slight distortions of the portions to which the piezoelectric film sensors 32 are attached).

In addition, the recording apparatus 1 of the present working example has a configuration that determines displacement of the piezoelectric film sensors 32 using a plurality of criteria in the control section 18, and can change stopping of at least one of the discharge of the ink by the carriage 11 and the transport of the recording medium P by the transport section 9 depending on the size of the displacement. That is, the recording apparatus 1 has a configuration that can stop a liquid discharge action using different methods depending on a degree of contact between the recording medium P and the carriage 11. More specifically, the recording apparatus 1 of the present working example has two threshold values for performing displacement determination of the piezoelectric film sensors 32. Further, in a case in which displacement that is greater than or equal to a first threshold value but less than a second threshold value, is detected, reciprocation of the carriage 11 is stopped after moving the carriage 11 to a home position (a position in which it is possible to perform capping of the recording head 12 using a cap, which is not illustrated in the drawings). In addition, in a case in which displacement that is greater than or equal to the second threshold value, is detected, reciprocation of the carriage 11 is stopped immediately. In this manner, as a result of the control of the control section 18, the recording apparatus 1 of the present working example has a configuration that can stop a liquid discharge action waiting for a convenient timing to stop in a case in which the degree of contact between the recording medium P and the carriage 11 is light, and stop a liquid discharge action immediately in a case in which the degree of contact between the recording medium P and the carriage 11 is heavy.

Next, an electrical configuration of the recording apparatus 1 of the present working example will be described.

Figure 4:
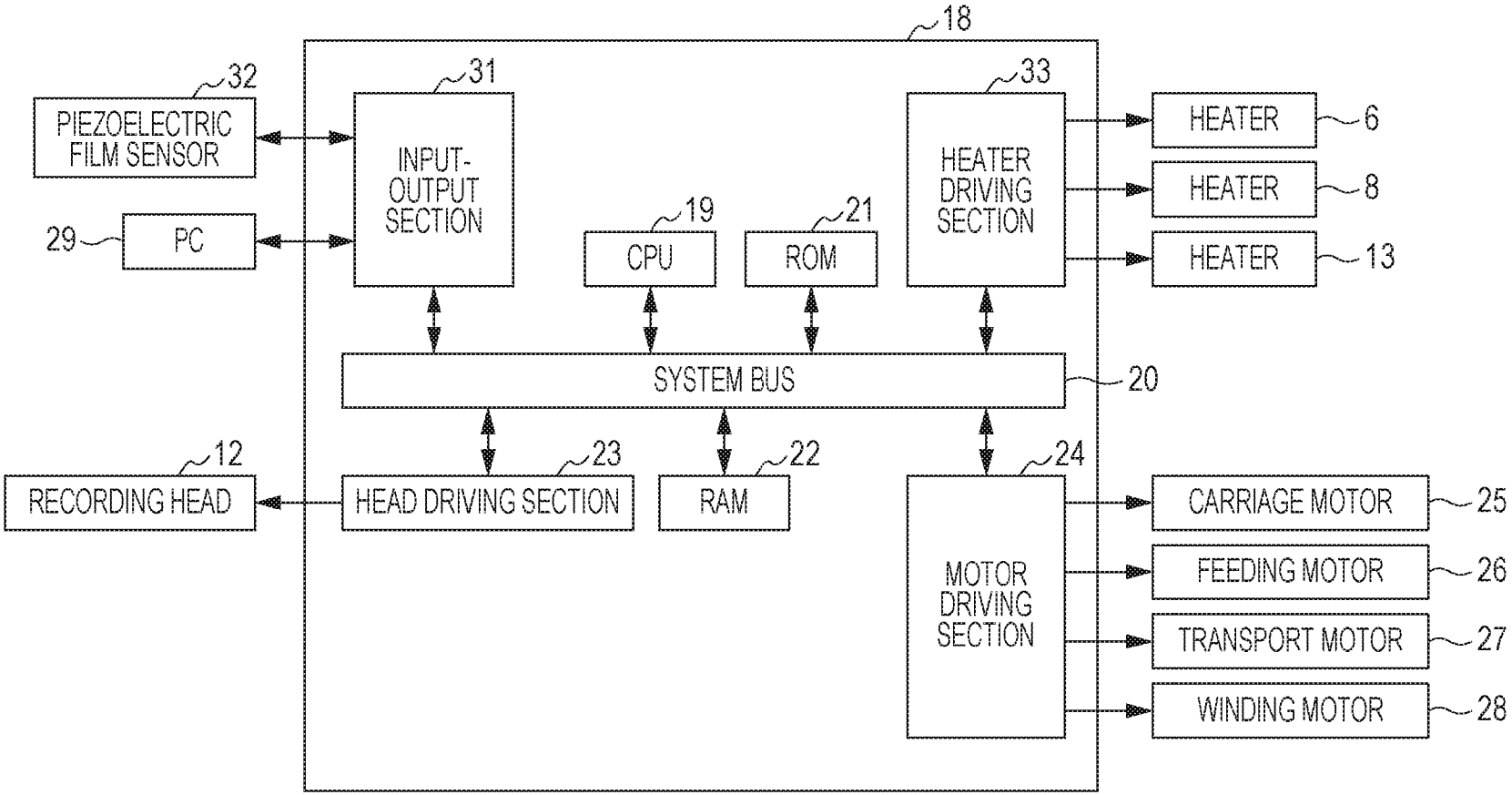
FIG. 4 is a block diagram of the recording apparatus according to Working Example 1 of the invention.

FIG. 4 is a block diagram that shows of the recording apparatus 1 of the present working example.

A CPU 19 that manages overall control of the recording apparatus 1 is provided in the control section 18. The CPU 19 is connected via a system bus 20 to a ROM 21, in which various control programs and the like, that the CPU 19 executes are stored, and a RAM 22 that is capable of temporarily storing data.

In addition, the CPU 19 is connected via the system bus 20 to a head driving section 23 for driving the recording head 12.

In addition, the CPU 19 is connected via the system bus 20 to a motor driving section 24 for driving a carriage motor 25 for moving the carriage 11, a delivery motor 26, which is a driving source of the setting section 14, a transport motor 27, which is a driving source of the driving roller 5, and a wind-up motor 28, which is a driving source of the wind-up section 15.

In addition, the CPU 19 is connected via the system bus 20 to a heater driving section 33 for driving the heaters 6, 8 and 13.

Furthermore, the CPU 19 is connected via the system bus 20 to an input-output section 31, and the input-output section 31 is connected to the piezoelectric film sensors 32 and a PC 29, which is an external apparatus that inputs data such as recording data to the recording apparatus 1. The PC 29 has a function as an "input section", which will be described later.

Working Example 2

FIG. 5

Next, a recording apparatus of Working Example 2 will be described in detail with reference to the drawings.

Figure 5:
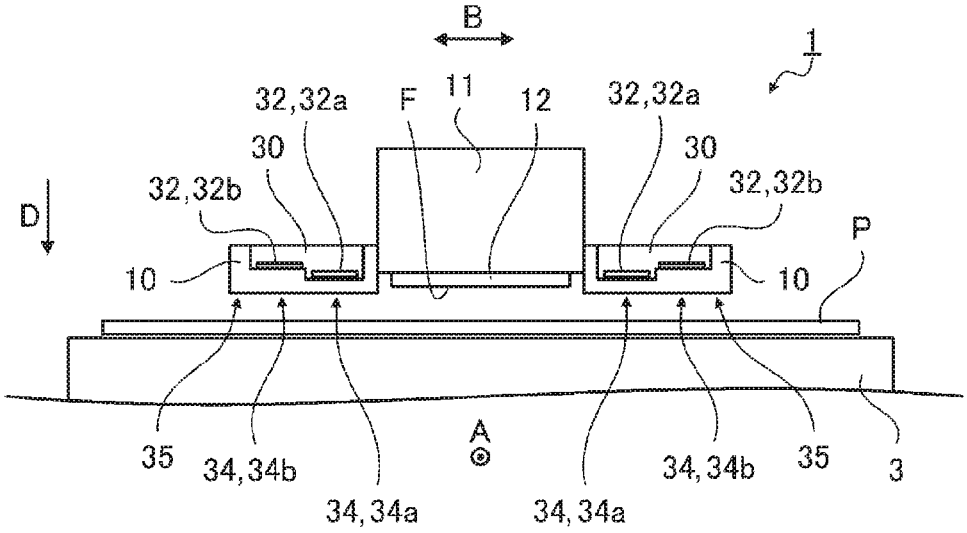
FIG. 5 is a schematic front cross-sectional view that shows the main sections of the recording apparatus according to Working Example 2 of the invention.

FIG. 5 is a schematic front cross-sectional view that shows the main sections of a recording apparatus 1 of the present working example, and is a drawing that corresponds to FIG. 3 of the recording apparatus 1 of Working Example 1. Additionally, the same reference numerals will be given to constituent members that are shared with the abovementioned Working Example 1, and detailed description thereof will be omitted. In addition, except for the configurations of the piezoelectric film sensors 32 and the skirts 10, the recording apparatus 1 of the present working example has the same configuration as that of the recording apparatus 1 of Working Example 1.

As shown in FIG. 3, in the recording apparatus 1 of Working Example 1, a single piezoelectric film sensor 32 is respectively provided in the skirts 10 of both side end sections of the carriage 11.

Meanwhile, as shown in FIG. 5, in the recording apparatus 1 of the present working example, two piezoelectric film sensors 32*a* and 32*b* are respectively provided in the skirts 10 of both side end sections of the carriage 11. Furthermore, the piezoelectric film sensors 32 are provided in a plurality of the piezoelectric film sensors 32*a* and 32*b* in each skirt 10 of the present working example, the piezoelectric film sensor 32*a* is attached to an attachment section 34*a*, and the piezoelectric film sensor 32*b* is attached to an attachment section 34*b*. Further, as shown in FIG. 5, in the attachment sections 34*a* and 34*b* of each piezoelectric film sensor 32, the thicknesses in the direction D differ, and the respective rigidities thereof are different. That is, as a result of the piezoelectric film sensors 32 being provided in portions having different rigidities, even in a case in which the detection criteria of displacement of each piezoelectric film sensor 32 are equivalent (there is a single threshold value for performing displacement determination of each piezoelectric film sensor 32, and the values are equivalent), since the degree of deformation of the positions in which the piezoelectric film sensors 32 are provided, differ, the recording apparatus 1 has a configuration that can determine a degree of contact between the recording medium P and the carriage 11 using a plurality of criteria. Therefore, the recording apparatus 1 has a configuration that can stop a liquid discharge action using different methods depending on the degree of contact between the recording medium P and the carriage 11.

Additionally, in the carriage 11 of the present working example, the piezoelectric film sensors 32*a* and 32*b* are provided in the same skirt 10 in portions having different rigidities (the attachment sections 34*a* and 34*b*). However, the recording apparatus 1 need not have this configuration, and may have a configuration in which the positions of each attachment section 34 of a plurality of piezoelectric film sensors 32 differ (for example, a configuration of being in the skirt 10 and on the side surface of the carriage 11, or the like), or a configuration in which the attachment directions of each piezoelectric film sensor 32 differs. The reason for this is that it is possible to easily determine the degree of contact between the recording medium P and the carriage 11 using a plurality of criteria since the degree of deformation of the positions in which the piezoelectric film sensors 32 are provided also respectively differ in configurations such as these.

In addition, the recording apparatus 1 of the present working example has a configuration that determines displacement of the respective piezoelectric film sensors 32 using a plurality of criteria in the control section 18, and can change stopping of at least one of the discharge of the ink by the carriage 11 and the transport of the recording medium P by the transport section 9 depending on the displacement. That is, the recording apparatus 1 has a configuration that can stop a liquid discharge action using different methods depending on a degree of contact between the recording medium P and the carriage 11. More specifically, the recording apparatus 1 of the present working example has a threshold value for performing displacement determination of the piezoelectric film sensors 32. Further, in a case in which displacement that is greater than or equal to the threshold value, is detected in the piezoelectric film sensor 32*a*, in which it is easy to detect displacement, only, reciprocation of the carriage 11 is stopped after moving the carriage 11 to a home position (a position in which it is possible to perform capping of the recording head 12 using a cap, which is not illustrated in the drawings). In addition, in a case in which displacement that is greater than or equal to the threshold value, is detected in the piezoelectric film sensor 32*b*, in which it is difficult to detect displacement, reciprocation of the carriage 11 is stopped immediately. In this manner, as a result of the control of the control section 18, the recording apparatus 1 of the present working example has a configuration in which it is possible to stop a liquid discharge action waiting for a convenient timing to stop in a case in which the degree of contact between the recording medium P and the carriage 11 is light, and stop a liquid discharge action immediately in a case in which the degree of contact between the recording medium P and the carriage 11 is heavy.

Working Example 3

FIG. 6

Next, a recording apparatus of Working Example 3 will be described in detail with reference to the drawings.

Figure 6:
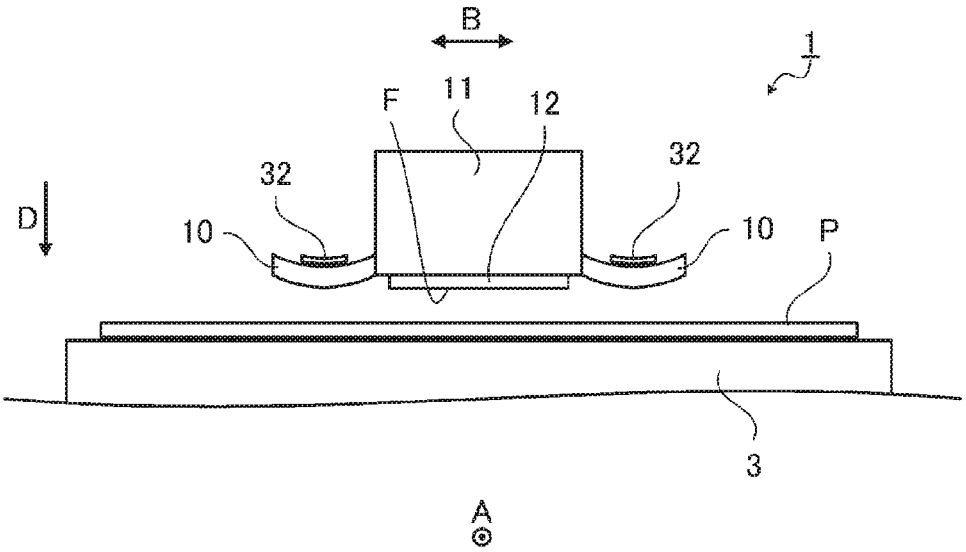
FIG. 6 is a schematic front cross-sectional view that shows the main sections of the recording apparatus according to Working Example 3 of the invention.

FIG. 6 is a schematic front cross-sectional view that shows the main sections of a recording apparatus 1 of the present working example, and is a drawing that corresponds to FIG. 3 of the recording apparatus 1 of Working Example 1. Additionally, the same reference numerals will be given to constituent members that are shared with the abovementioned Working Examples 1 and 2, and detailed description thereof will be omitted. In addition, except for the configurations of the piezoelectric film sensors 32 and the skirts 10, the recording apparatus 1 of the present working example has the same configuration as that of the recording apparatus 1 of Working Example 1.

As shown in FIG. 3, in the recording apparatus 1 of Working Example 1, the piezoelectric film sensors 32 are respectively provided in planar portions of the skirts 10 of both side end sections of the carriage 11.

Meanwhile, as shown in FIG. 6, in the recording apparatus 1 of the present working example, the skirts 10 of both side end sections of the carriage 11 are made to have curved surface forms, and the piezoelectric film sensors 32 are pasted onto the curved surfaces.

The piezoelectric film sensors 32 can be pasted onto curved surfaces since the piezoelectric film sensors 32 are film form. In addition, as a result of the carriage 11 having curved surfaces, for example, it is possible to reduce damage to both the recording medium P and the carriage 11 in a case in which the recording medium P and the carriage 11 come into contact with one another. The skirts 10 of the present working example have a structure that has curved surfaces on the lower side thereof when viewed from the transport direction A (from the front), and have a configuration that can suppress heavy contact between the recording medium P and the carriage 11 when the carriage 11 is caused to reciprocate in the intersecting direction B. The reason for this is that it is possible to apply a force to the recording medium P in a direction that pushes the recording medium P down using the curved surfaces in a case in which the recording medium P and the carriage 11 come into contact with one another when the carriage 11 is caused to reciprocate.

Therefore, the carriage 11 of the recording apparatus 1 of the present working example has curved surfaces, and the piezoelectric film sensors 32 are pasted onto the curved surfaces. That is, it is possible to set a configuration in which the carriage 11 has curved surfaces without forcibly configuring planar sections, and the degree of freedom of the configuration of the carriage 11 is increased.

Working Example 4

Figure 7:
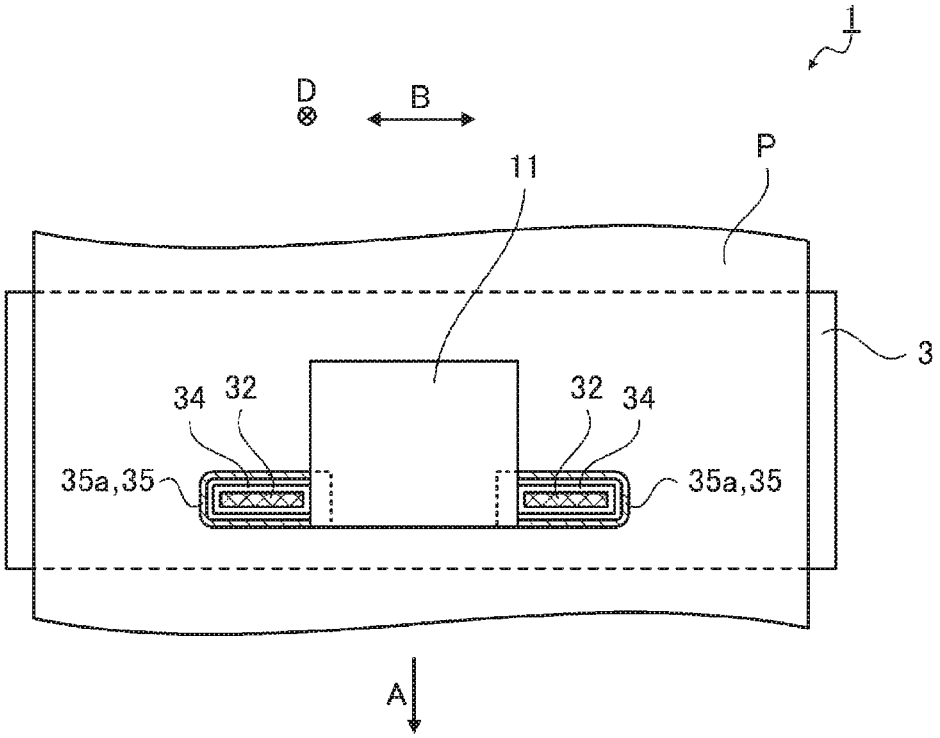
FIG. 7 is a schematic plan view that shows main sections of the recording apparatus according to Working Example 4 of the invention.
Figure 8:
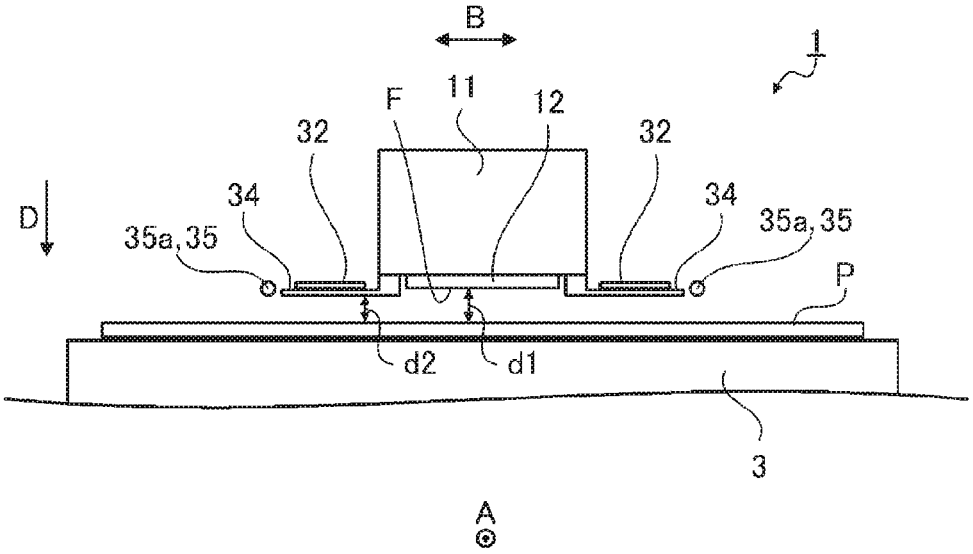
FIG. 8 is a schematic front cross-sectional view that shows the main sections of the recording apparatus according to Working Example 4 of the invention.

FIGS. 7 and 8

Next, a recording apparatus of Working Example 4 will be described in detail with reference to the drawings.

FIG. 7 is a schematic plan view that shows the main sections of a recording apparatus 1 of the present working example, and is a drawing that corresponds to FIG. 2 of the recording apparatus 1 of Working Example 1. FIG. 8 is a schematic front cross-sectional view that shows the main sections of a recording apparatus 1 of the present working example, and is a drawing that corresponds to FIG. 3 of the recording apparatus 1 of Working Example 1. Additionally, the same reference numerals will be given to constituent members that are shared with the abovementioned Working Examples 1 to 3, and detailed description thereof will be omitted. In addition, except for the configurations of the piezoelectric film sensors 32 and the skirts 10, the recording apparatus 1 of the present working example has the same configuration as that of the recording apparatus 1 of Working Example 1.

As shown in FIG. 2 and FIG. 3, in the recording apparatus 1 of Working Example 1, the attachment sections 34 of the piezoelectric film sensors 32 are configured as bottom surface portions of the hole sections 30, which are provided in the skirts 10, and the attachment sections 34 are configured integrally with the peripheral sections 35 (the peripheral sections of the hole sections 30).

Meanwhile, as shown in FIGS. 7 and 8, in the recording apparatus 1 of the present working example, the peripheral sections 35 are provided as bumpers 35*a*, which are separated from the attachment sections 34.

More specifically, the attachment sections 34 are plate-shaped bodies that extend in the intersecting direction B in a manner that faces the recording medium P, and are fixed to both side end sections in the intersecting direction B of the carriage 11 in a manner in which one end section of the attachment sections 34 is disposed in a position at the same height as the attachment sections 34 in Working Example 1 (a position in which an interval between the recording medium P and the lower surfaces of the attachment sections 34 is the interval d2). Except for the fixed end sections, the peripheries of the attachment sections 34 are guarded by the bumpers 35*a*, and the other end sections of the attachment section 34 are configured as free end sections of cantilever beams. The piezoelectric film sensors 32 are pasted onto the upper surfaces (surfaces that are opposite to surfaces that face the recording medium P) of the attachment sections 34 in a manner in which the longitudinal direction thereof is the intersecting direction B.

That is, in the recording apparatus 1 of the present working example, the skirts 10 are configured solidly by configuring the peripheral sections 35 (the bumpers 35*a*) with high rigidity while increasing detection accuracy by making it easier for the attachment sections 34 of the piezoelectric film sensors 32 to become warped as cantilever beams. Therefore, the recording apparatus 1 has a configuration in which it is possible to form the carriage 11 with high detection accuracy in a manner in which it is difficult to break, and it is possible to effectively suppress a circumstance in which at least one of the recording medium P and the carriage 11 becomes damaged due to the recording medium P and the carriage 11 coming into contact with one another.

Next, a control method of the control section 18 that is characteristic of the present embodiment will be described. A basic control method of the control section 18 is a control method that is shared by Working Examples 1 to 4, and is a method that identifies an extent of a state in which the recording medium P is in contact with the carriage 11 (the liquid discharging section), and can perform control depending on the extent thereof.

Figure 9:
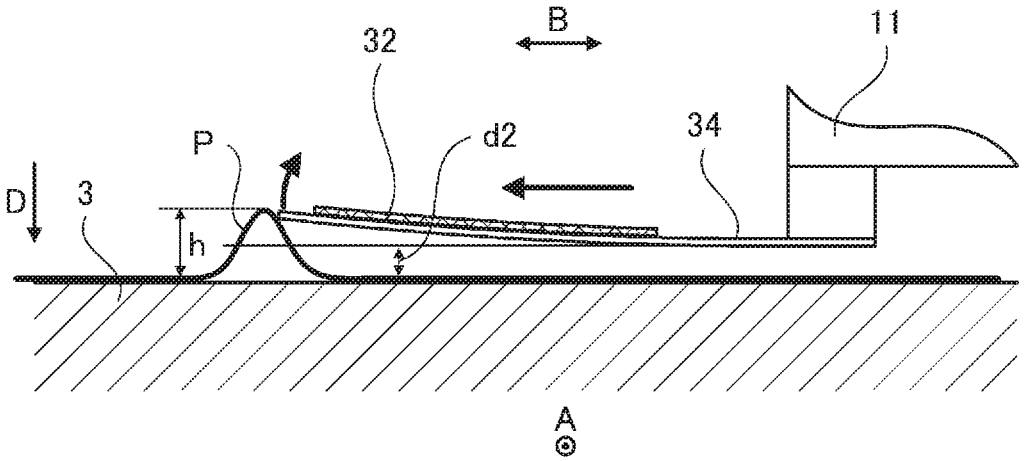
FIG. 9 is a conceptual diagram that shows a state in which a recording medium is in contact with a liquid discharging section.

FIG. 9 is a conceptual diagram that shows a state in which the recording medium P is in contact with the liquid discharging section (more specifically, an attachment section 34) using the configuration of Working Example 4 as an example. Additionally, illustration of the bumper 35*a* is omitted.

For example, in a case in which a wrinkle having a height h, which exceeds the interval d2 between the recording medium P and the lower surface of the attachment section 34, is generated in a recording medium P being transported on the upper surface of the platen 3, and the recording medium P causes the attachment section 34 to become deformed as a result of coming into contact with the lower surface of the attachment section 34, the output of a value based on the displacement (deformation) of the piezoelectric film sensor 32 that depends on the amount of deformation of the attachment section 34, is obtained from the piezoelectric film sensor 32.

In this instance, in a case in which the rigidity of the recording medium P differs, even if the height h of the wrinkle in the recording medium P is the same before coming into contact with the lower surface of the attachment section 34, the output of the piezoelectric film sensor 32 differs since the amount that the recording medium P causes the attachment section 34 to warp due to contact differs.

In addition, even if the rigidity of the recording medium P and the height h of the wrinkle in the recording medium P is the same before coming into contact with the lower surface of the attachment section 34, in a case in which the speed with which the wrinkle in the recording medium P comes into contact with (impacts with) the attachment section 34 differs, the output of the piezoelectric film sensor 32 differs.

In this manner, in order to suppress damage to the recording medium P or the liquid discharging section (more specifically, the recording head 12, for example) due to interference of the recording medium P with the liquid discharging section (the carriage 11), it is necessary to identify the extent of a practical contact state in the output value of the piezoelectric film sensor 32. The reason for this is that, for example, even in a case in which the rigidity of the recording medium P is low, and the output of the piezoelectric film sensor 32, which is generated due to contact with the recording medium P, is small, there are cases in which the wrinkle in the recording medium P is high, and the recording medium P and the recording head 12 become damaged due to the wrinkle becoming caught on the recording head 12.

In such an instance, in the present embodiment, identification of the extent of a state of contact is performed, and it is possible to perform control depending on the identified state. Hereinafter, a plurality of control examples that differ in the element for performing identification of the extent of the state of contact, will be described.

Control Example 1

The present control example is characterized by the control section 18 performing control of the carriage 11 (the liquid discharging section) and/or the transport section 9 on the basis of the outputs of the piezoelectric film sensors 32 and attribute information of the recording medium P.

More specifically, a correlation relationship between the expected heights h of wrinkles in the recording medium P, and the sizes of the outputs of the piezoelectric film sensors 32 are evaluated in advance for each type of recording medium P that the recording apparatus 1 uses as a target, and the correlation relationship is prepared as a function or a table. The prepared function or table is stored in the ROM 21 (refer to FIG. 4) for each type of recording medium P. That is, the ROM 21 has a function as a "storage section" that stores attribute information of a plurality of the recording media P. Additionally, for example, a hard disk drive (HDD) provided in the PC 29, a hard disk drive (HDD) that is usable as a result of being connected to the system bus 20, or the like, may be used as the "storage section".

The attribute information of the recording medium P is information that includes information (for example, a name or model number of the recording medium P) from which the type of recording medium P can be identified. As a result of the attribute information of the recording medium P to be recorded on being input from the PC 29, as the "input section", the control section 18 can acquire the corresponding function of table that is associated with the attribute information from the ROM 21. The control section 18 can estimate the height h of a contacting wrinkle in the recording medium P from the outputs of the piezoelectric film sensors 32 and the corresponding function or table. In addition, the control section 18 can perform control according to the estimated height h of the contacting wrinkle in the recording medium P.

Additionally, the attribute information of the recording medium P need not be limited to information from which it is possible to identify the type of the recording medium P, and for example, a function or table, which indicates the correlation relationship between the heights h of wrinkles in the recording medium P and outputs of the piezoelectric film sensors 32, itself may be used as the attribute information. That is, the control section 18 can perform the same control (control according to the estimated height h of the contacting wrinkle in the recording medium P) as a result of a corresponding function or table, which indicates the correlation relationship between the heights h of wrinkles in the recording medium P and outputs of the piezoelectric film sensors 32, being input from the PC 29.

In addition, the attribute information of the recording medium P may be a physical constant such as the rigidity of the recording medium P. In this case, it is suitable if the function or table, which indicates the correlation relationship between the heights h of wrinkles in the recording medium P and outputs of the piezoelectric film sensors 32, is a function or table that is determined using the rigidity of the recording medium P. It is possible for the control section 18 to perform the same control as a result of a rigidity value of the recording medium P being input from the PC 29 as the attribute information of the recording medium P.

Control Example 2

The present control example is characterized by the control section 18 performing control of the carriage 11 (the liquid discharging section) and/or the transport section 9 on the basis of the outputs of the piezoelectric film sensors 32, the attribute information of the recording medium P and the transport velocity of the recording medium P.

More specifically, a correlation relationship between the expected heights h of wrinkles in the recording medium P, and the sizes of the outputs of the piezoelectric film sensors 32 are evaluated and prepared in advance as a function or table determined using the transport velocity for each type of recording medium P that the recording apparatus 1 uses as a target. The prepared function or table is stored in the ROM 21 (refer to FIG. 4) for each type of recording medium P.

As a result of the attribute information of the recording medium P to be recorded on being input from the PC 29, the control section 18 can acquire the corresponding function of table that is associated with the attribute information from the ROM 21. The control section 18 can estimate the height h of a contacting wrinkle in the recording medium P from the transport velocity of the recording medium P at a point in time at which the output of the piezoelectric film sensor 32 is obtained on the basis of the output of the piezoelectric film sensor 32 and the corresponding function or table. In addition, the control section 18 can perform control according to the estimated height h of the contacting wrinkle in the recording medium P.

Additionally, since the transport velocity of the recording medium P is a value that is established by the transport motor 27 (refer to FIG. 4), which the control section 18 controls, it is possible to derive the transport velocity of the recording medium P in the control section 18.

Additionally, the present control example is primarily useful in a recording apparatus that is provided with a line head. In a case of a recording apparatus that is provided with a line head, it is preferable that a plurality of the piezoelectric film sensors 32 are attached to one edge (an upstream side in the transport direction A) of the line head that extends in which intersecting direction B.

Control Example 3

The present control example is characterized by the control section 18 performing control of the carriage 11 (the liquid discharging section) and/or the transport section 9 on the basis of the output of the piezoelectric film sensor 32, the attribute information of the recording medium P, the transport velocity of the recording medium P a movement velocity of the carriage 11 (the liquid discharging section) in the intersecting direction B.

More specifically, a correlation relationship between the expected heights h of wrinkles in the recording medium P, and the sizes of the outputs of the piezoelectric film sensors 32 are evaluated and prepared in advance as a function or table determined using the transport velocity and the movement velocity of the carriage 11 (the liquid discharging section) for each type of recording medium P that the recording apparatus 1 uses as a target. The prepared function or table is stored in the ROM 21 (refer to FIG. 4) for each type of recording medium P.

As a result of the attribute information of the recording medium P to be recorded on being input from the PC 29, the control section 18 can acquire the corresponding function of table that is associated with the attribute information from the ROM 21. The control section 18 can estimate the height h of a contacting wrinkle in the recording medium P from the transport velocity of the recording medium P and the movement velocity of the carriage 11 (the liquid discharging section) at a point in time at which the output of the piezoelectric film sensor 32 is obtained on the basis of the output of the piezoelectric film sensor 32 and the corresponding function or table. In addition, the control section 18 can perform control according to the estimated height h of the contacting wrinkle in the recording medium P.

Additionally, since the movement velocity of the carriage 11 (the liquid discharging section) is a value that is established by the carriage motor 25 (refer to FIG. 4), which the control section 18 controls, it is possible to derive the movement velocity of the carriage 11 (the liquid discharging section) in the control section 18.

Next, an example of control according to an identified state of contact will be described.

In the above-mentioned control examples, description was given with the height h of a contacting wrinkle in the recording medium P being estimated as the state of identified contact, but it is not necessary to limit the state of identified contact to the parameter of the height h of the contacting wrinkle in the recording medium P. An extent of contact that corresponds to a control specification in which the estimated height h of wrinkles in the recording medium P, is assumed, may be set, and for example, a level value that depends on the extent may be used as a parameter. As a simple example, it is possible to allocate numerical values such as no contact=0, light contact for which there is no concern of damage=1, contact for which there is a concern of damage=2, and the like. In other words, a method in which threshold values, in which a corresponding extent is determined with respect to the detected output value of the piezoelectric film sensor 32, are provided in the above-mentioned function or table, may be used.

Figure 10:
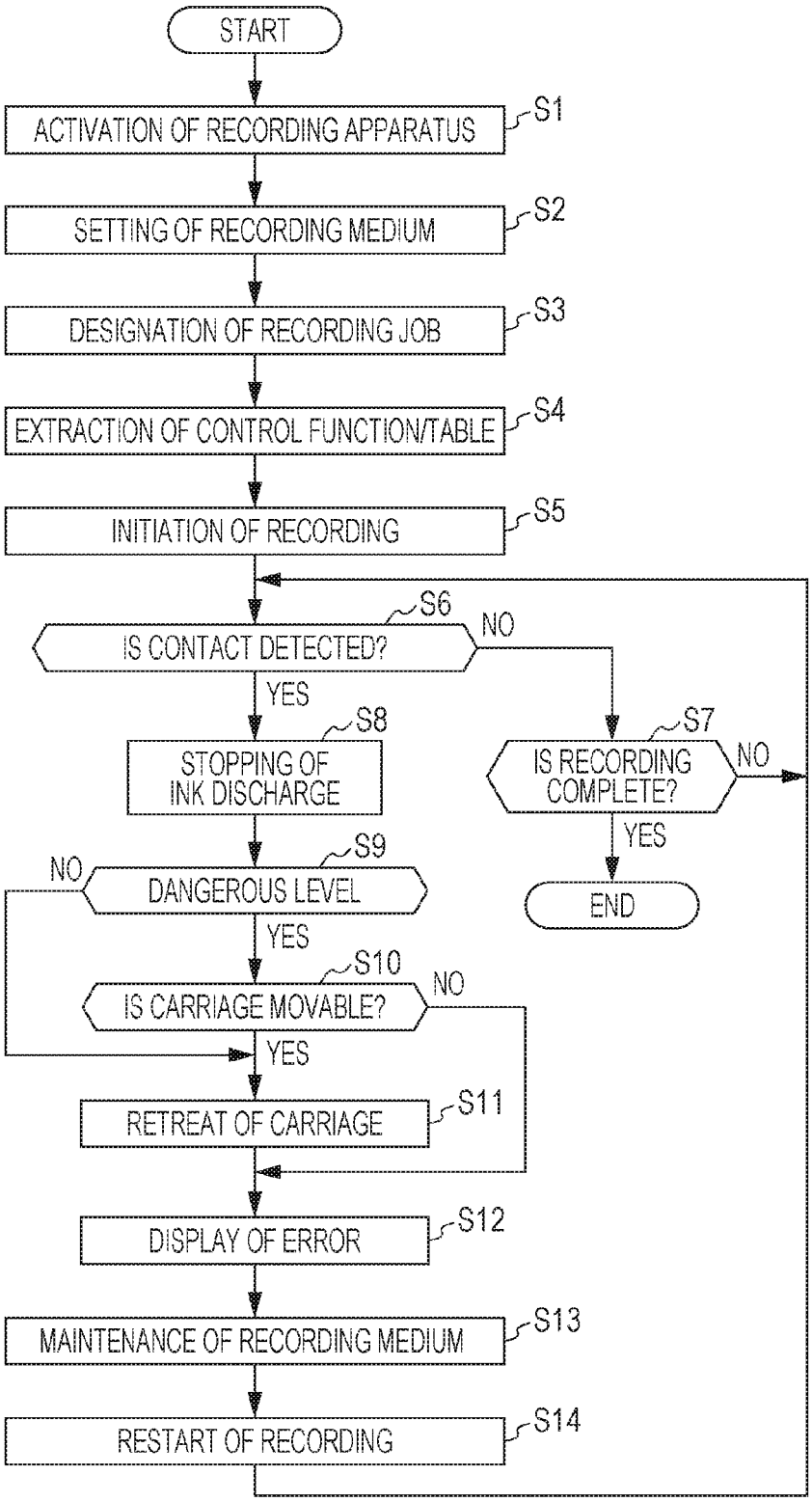
FIG. 10 is a flowchart that shows a series of recording actions of a recording apparatus.

FIG. 10 is a flowchart that shows a series of recording actions including work of an operator of the recording apparatus 1.

The flowchart includes a control sequence of the control section 18 in a case in which contact with the recording medium P is detected.

Firstly, the recording apparatus 1 is activated (Step S1).

Next, the recording medium P is set (Step S2).

Next, a recording job is designated (Step S3) from the PC 29. The recording job is a data package of information that is required in order to execute a recording operation in the recording apparatus 1, and includes information that designates image data to be recorded, a recording quality (clear, high-definition, or the like), a recording amount (a number of recording copies, or the like), a recording medium P (attribute information of the recording medium P) and the like.

Next, when the recording job is designated, the control section 18 extracts a function or table (a function or table in which the size of the output of the piezoelectric film sensors 32 is made to correspond to an extent of contact, which is made to correspond to a control specification in which the estimated height h of wrinkles in the recording medium P are assumed), which performs control of the recording job, from the ROM 21 (Step S4), and initiates recording (Step S5).

When recording is initiated, the piezoelectric film sensors 32 initiate detection of the presence or absence of contact with the recording medium P (Step S6).

In a case in which the piezoelectric film sensors 32 do not detect contact with the recording medium P (a case of No in Step S6), recording continues, and a recording operation is completed in a case in which recording designated by the recording job is completed (a case of Yes in Step S7 that determines the completion of recording).

In a case in which contact with the recording medium P is detected (a case of Yes in Step S6), a discharge operation of ink is stopped immediately (Step S8), and the extent of the contact with the recording medium P is determined (Step S9).

In a case in which the extent of the contact with the recording medium P is at a dangerous level (for example, the above-mentioned level of contact for which there is a concern of damage=2) (a case of Yes in Step S9), it is determined whether or not it is possible for the carriage 11 to move (Step S10).

In a case in which the extent of the contact with the recording medium P is not a dangerous level (for example, the above-mentioned level of light contact for which there is not a concern of damage=1) (a case of No in Step S9), and a case in it is possible for the carriage 11 to move (a case of Yes in Step S10) even if the extent of the contact with the recording medium P is at a dangerous level (a case of Yes in Step S9), the carriage 11 is moved to a retreat region that is outside a region that faces the platen 3 (Step S11).

In a case in which it is not possible for the carriage 11 to move (a case of No in Step S10) when the extent of the contact with the recording medium P is at a dangerous level (a case of Yes in Step S9), the carriage 11 remains stopped.

Additionally, determination of whether or not it is possible for the carriage 11 to move in Step S10 can be performed as a result of the control section 18 sensing a motor load of the carriage motor 25.

Next, error display that depends on the extent of the contact with the recording medium P is performed (Step S12). For example, the error display is performed on a display screen of the PC 29.

An operator of the recording apparatus 1 performs an appropriate procedure (maintenance of the recording medium P) in accordance with the error display (Step S13), and recording is restarted (Step S14).

Additionally, the reason for moving the carriage 11 to the retreat region that is outside a region that faces the platen 3 in Step S11 is to facilitate maintenance work of the operator.

In the abovementioned manner, according to the liquid discharging apparatus (the recording apparatus 1) of the present embodiment, it is possible to obtain the following effects.

The piezoelectric film sensors 32, which output depending on the extent of deformation due to contact with the recording medium P, are provided in the liquid discharging section (the carriage 11), and in Control Example 1, the control section 18 performs control of the liquid discharging section (the carriage 11) and/or the transport section 9 on the basis of the outputs of the piezoelectric film sensors 32 and the attribute information of the recording medium P. Therefore, even in a case in which the extents of deformation of the piezoelectric film sensors 32 differ as a result of the rigidity of contacting recording media P differing, it is possible to perform control of the liquid discharging section (the carriage 11) and/or the transport section 9 more suitably by identifying the recording medium P on the basis of the attribute information of the recording medium P.

In other words, even in a case in which the extents of the deformation of the piezoelectric film sensors 32 differ as a result of the rigidity of contacting recording media P differing, it is possible to detect the outputs of the piezoelectric film sensors 32 as appropriate level that correspond to the recording medium P by identifying the recording medium P on the basis of the attribute information of the recording medium P.

In addition, in Control Example 2, the control section 18 performs control of the liquid discharging section (the carriage 11) and/or the transport section 9 on the basis of the outputs of the piezoelectric film sensors 32, the attribute information of the recording medium P and the transport velocity of the recording medium P. Therefore, even in a case in which the extents of deformation of the piezoelectric film sensors 32 differ as a result of the rigidity and speed of contact (transport velocity) of contacting recording media P differing, it is possible to perform control of the liquid discharging section (the carriage 11) and/or the transport section 9 more suitably by identifying the states of the rigidity and speed of contact.

In other words, even in a case in which the extents of deformation of the piezoelectric film sensors 32 differ as a result of the rigidity and speed of contact (transport velocity) of contacting recording media P differing, it is possible to detect the outputs of the piezoelectric film sensors 32 as appropriate level that correspond to the recording medium P by identifying the states of the rigidity and speed of contact.

In addition, the liquid discharging section (the carriage 11) is capable of discharging the ink while moving in the intersecting direction B, which intersects the transport direction, and in Control Example 3, the control section 18 performs control of the liquid discharging section (the carriage 11) and/or the transport section 9 on the basis of the outputs of the piezoelectric film sensors 32, the attribute information of the recording medium P, the transport velocity of the recording medium P and the movement velocity of the liquid discharging section (the carriage 11), which moves in the intersecting direction B. Therefore, even in a case in which the extents of deformation of the piezoelectric film sensors 32 differ as a result of the rigidity and speed of contact (transport velocity and movement velocity of the liquid discharging section (the carriage 11), which moves in the intersecting direction B) of contacting recording media P differing, it is possible to perform control of the liquid discharging section (the carriage 11) and/or the transport section 9 more suitably by identifying the states of the rigidity and speed of contact.

In other words, even in a case in which the extents of deformation of the piezoelectric film sensors 32 differ as a result of the rigidity and speed of contact (transport velocity and movement velocity of the liquid discharging section (the carriage 11), which moves in the intersecting direction B) of contacting recording media P differing, it is possible to detect the outputs of the piezoelectric film sensors 32 as appropriate level that correspond to the recording medium P by identifying the states of the rigidity and speed of contact.

In addition, since the recording apparatus 1 is provided with the PC 29, which inputs the attribute information of the recording medium P, as an input section, even in a case in which the extents of deformation of the piezoelectric film sensors 32 differ as a result of the rigidity of contacting recording media P differing, it is possible to perform control of the liquid discharging section and/or the transport section 9 more suitably by identifying the recording medium P on the basis of the input attribute information of the recording medium P.

Additionally, the invention is not limited to the above-mentioned embodiment, and it is possible to apply various changes and improvements to the above-mentioned embodiment. A modification example will be mentioned below. In this instance, constituent sites that are the same as those of the above-mentioned embodiment will be given the same reference numerals, and overlapping descriptions thereof will be omitted.

Modification Example 1

In Embodiment 1, description was given with attribute information of the recording medium P to be recorded on being input from the PC 29 as the "input section", but the invention is not limited to this configuration, and may have a configuration that is provided with an "identification section" that identifies a recording medium P being transported by the transport section 9, and acquires the attribute information of the recording medium P using information obtained from the identification section.

It is possible to use a device that is provided with an image sensor that can discriminate between types of recording medium P by combining reflective characteristics of the recording medium P and unevenness information of the surface thereof, as the identification section.

According to the liquid discharging apparatus (the recording apparatus 1) of the present modification example, since the recording apparatus 1 is provided with the ROM 21 (or a hard disk drive (HDD)) as the "storage section" that stores the attribute information of a plurality of the recording media P, it is possible to register a plurality of the recording media P on which the recording apparatus 1 records, in advance. In addition, since the recording apparatus 1 is provided with the identification section that identifies the recording medium P that is transported by the transport section 9, among a plurality of registered recording media P, it is possible to identify which recording medium P is set as a recording target. Therefore, even in a case in which the extents of deformation of the piezoelectric film sensors 32 differ as a result of the rigidity of contacting recording media P differing, it is possible to perform control of the liquid discharging section and/or the transport section 9 more suitably on the basis of the attribute information of the recording medium P that is set as a target.

This application claims priority under 35 U.S.C. §119 to Japanese Patent Application No. 2015-148674, filed Jul. 28, 2015 and 2016-095114, filed May 11, 2016. The entire disclosure of Japanese Patent Application No. 2015-148674 and 2016-095114 is hereby incorporated herein by reference.

What is claimed is:

1. A liquid discharging apparatus comprising:

a liquid discharging section that discharges a liquid onto a medium, wherein the liquid discharging section includes:

a recording head; and a skirt, wherein a piezoelectric film sensor is provided in the skirt; and a transport section that transports the medium in a transport direction, wherein an interval between a lower surface of the skirt and the medium is narrower than an interval between a lower surface of the recording head and the medium; and wherein at least a portion of a width of the skirt narrows from a rear of the skirt to a front of the skirt in the transport direction.

2. The liquid discharging apparatus according to claim 1, wherein the liquid discharging section is capable of discharging the liquid while reciprocating in an intersecting direction, which intersects a transport direction of the medium, and wherein detection of displacement of the piezoelectric film sensor is performed effectively in a constant movement rate period in the reciprocation of the liquid discharging section.

3. The liquid discharging apparatus according to claim 1, wherein the piezoelectric film sensor is disposed in an attachment section of the skirt, wherein the attachment section is configured so that the rigidity thereof is lower than a rigidity of a peripheral section of the skirt.

4. The liquid discharging apparatus according to claim 1, wherein a plurality of the piezoelectric film sensors are provided in the liquid discharging section in respective attachment sections, wherein at least one of the respective attachment section rigidities and positions of each piezoelectric film sensor, and the attachment directions of each piezoelectric film sensor is different.

5. The liquid discharging apparatus according to claim 1, wherein displacement of the piezoelectric film sensor is determined using a plurality of criteria, and a manner of stopping at least one of discharge of the liquid by the liquid discharging section and transport of the medium by the transport section is changed depending on the size of the displacement.

6. The liquid discharging apparatus according to claim 2, wherein the piezoelectric film sensor is provided on both sides in a direction of reciprocation with respect to a discharge position of the liquid discharging section.

7. The liquid discharging apparatus according to claim 1, wherein the piezoelectric film sensor is pasted onto a curved surface.

8. The liquid discharging apparatus according to claim 1, at least one of discharge of the liquid by the liquid discharging section and transport of the medium by the transport section is stopped in a case in which displacement of the piezoelectric film sensor is detected.

9. The liquid discharging apparatus according to claim 1, wherein the piezoelectric film sensor is a sensor that is provided in the liquid discharging section, and wherein the sensor generates an output according to an extent of deformation of the piezoelectric film sensor due to contact with the medium, and wherein the liquid discharging apparatus further comprises a control section that performs control of the liquid discharging section and/or the transport section on the basis of the output of the piezoelectric film sensor and attribute information of the medium.

10. The liquid discharging apparatus according to claim 9, wherein the control section performs the control on the basis of a transport velocity of the medium.

11. The liquid discharging apparatus according to claim 9, wherein the liquid discharging section is capable of discharging the liquid while moving in an intersecting direction, which intersects the transport direction, and wherein the control section performs the control on the basis of a movement velocity of the liquid discharging section, which moves in the intersecting direction.

12. The liquid discharging apparatus according to claim 9, further comprising an input section, which inputs attribute information of the medium.

13. The liquid discharging apparatus according to claim 9, further comprising:

a storage section that stores attribute information of a plurality of the media; and an identification section that identifies the medium transported by the transport section.

14. A liquid discharging apparatus comprising:

a carriage arranged to reciprocate in an intersecting direction that is transverse to a transport direction of a medium, the carriage including at least one skirt arranged on a side of the carriage in the intersecting direction, wherein the skirt includes an attachment section;

a piezoelectric film sensor disposed in the attachment section, wherein an interval between a lower surface of the skirt and the medium is narrower than an interval between a lower surface of the recording head and the medium, and wherein a front portion of the skirt is narrower in the intersecting direction that a rear portion of the skirt.

* * * * *